US009182122B2

(12) United States Patent
Matthews et al.

(10) Patent No.: US 9,182,122 B2
(45) Date of Patent: Nov. 10, 2015

(54) COMBUSTOR AND METHOD FOR SUPPLYING FLOW TO A COMBUSTOR

(75) Inventors: John M. Matthews, Greer, SC (US); Keith C. Belsom, Laurens, SC (US); Ronald James Chila, Greenfield Center, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1037 days.

(21) Appl. No.: 13/253,537

(22) Filed: Oct. 5, 2011

(65) Prior Publication Data

US 2013/0086921 A1 Apr. 11, 2013

(51) Int. Cl.

| | |
|---|---|
| ***F23R 3/00*** | (2006.01) |
| ***F23R 3/04*** | (2006.01) |
| ***F23R 3/06*** | (2006.01) |
| ***F23R 3/08*** | (2006.01) |

(52) U.S. Cl.

CPC . *F23R 3/04* (2013.01); *F23R 3/005* (2013.01); *F23R 3/08* (2013.01); *F23R 3/002* (2013.01); *F23R 3/06* (2013.01); *F23R 2900/03044* (2013.01); *F23R 2900/03045* (2013.01)

(58) Field of Classification Search

CPC ..... F23R 3/04; F23R 3/06; F23R 3/08; F23R 3/44; F23R 3/50; F23R 3/54; F23R 2900/03043; F23R 2900/03044; F01D 9/023

See application file for complete search history.

(56) References Cited

U.S. PATENT DOCUMENTS

| | | | | |
|---|---|---|---|---|
| 4,719,748 | A * | 1/1988 | Davis et al. | 60/39.37 |
| 6,594,999 | B2 | 7/2003 | Mandai et al. | |
| 7,571,611 | B2 * | 8/2009 | Johnson et al. | 60/772 |
| 7,707,835 | B2 | 5/2010 | Lipinski et al. | |
| 2006/0283189 | A1 * | 12/2006 | Lipinski et al. | 60/772 |
| 2009/0139238 | A1 * | 6/2009 | Martling et al. | 60/740 |
| 2009/0145132 | A1 * | 6/2009 | Johnson et al. | 60/755 |
| 2010/0031665 | A1 * | 2/2010 | Chokshi et al. | 60/760 |
| 2011/0214429 | A1 * | 9/2011 | Chen et al. | 60/755 |
| 2011/0247339 | A1 * | 10/2011 | Chila et al. | 60/752 |
| 2012/0036857 | A1 * | 2/2012 | Bassani | 60/752 |
| 2012/0198855 | A1 * | 8/2012 | Cihlar et al. | 60/760 |
| 2012/0297784 | A1 * | 11/2012 | Melton et al. | 60/772 |
| 2012/0304652 | A1 * | 12/2012 | Crawley et al. | 60/740 |
| 2013/0074505 | A1 * | 3/2013 | Toronto et al. | 60/746 |
| 2013/0111909 | A1 * | 5/2013 | Khan et al. | 60/752 |
| 2013/0269359 | A1 * | 10/2013 | Hughes | 60/772 |

* cited by examiner

*Primary Examiner* — William H Rodriguez
*Assistant Examiner* — Rene Ford
(74) *Attorney, Agent, or Firm* — Dority & Manning, PA

(57) ABSTRACT

A device for supplying flow across a combustor includes an axial fluid injector configured to circumferentially surround at least a portion of the combustor. An inner annular passage extends through the axial fluid injector and provides fluid communication through the axial fluid injector and into a first annular passage that surrounds the combustor. An outer annular passage extends through the axial fluid injector radially outward from the inner annular passage and provides axial flow into the first annular passage. A method for supplying flow to a combustor includes flowing a first portion of a working fluid through a first axial flow path and flowing a second portion of the working fluid through a second axial flow path.

20 Claims, 4 Drawing Sheets

COMBUSTOR AND METHOD FOR SUPPLYING FLOW TO A COMBUSTOR

FIELD OF THE INVENTION

The present invention generally involves a combustor and method for supplying flow to a combustor. In particular embodiments, the combustor and method provide axial flow of a working fluid across the combustor.

BACKGROUND OF THE INVENTION

Combustors are commonly used in industrial and commercial operations to ignite fuel to produce combustion gases having a high temperature and pressure. For example, industrial gas turbines typically include one or more combustors to generate power or thrust. A typical commercial gas turbine used to generate electrical power includes an axial compressor at the front, one or more combustors circumferentially arranged around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles in each combustor where the compressed working fluid mixes with fuel and ignites in a combustion chamber to generate combustion gases having a high temperature and pressure. The combustion gases flow to the turbine to produce work. For example, expansion of the combustion gases in the turbine may rotate a shaft connected to a generator to produce electricity.

It is well-known that the thermodynamic efficiency of the gas turbine generally increases with higher combustion gas temperatures. However, higher combustion gas temperatures may also increase the production of undesirable emissions, reduce the design margins for flame flash back and/or flame holding, and/or expose various combustor components to excessive temperatures. As a result, a variety of techniques exist to allow higher combustion gas temperatures while minimizing undesirable exhaust emissions, flash back, flame holding, and excessive temperatures. Many of these techniques seek to enhance uniform mixing of the fuel and compressed working fluid prior to combustion to reduce or prevent localized hot spots in the combustion chamber associated with the undesirable emissions, flash back, and/or flame holding.

Additional techniques seek to increase cooling to the combustor components to prevent excessive temperatures from damaging the combustor components. Specifically, a portion of the working fluid may be directed across the outside of the combustor components exposed to the higher temperature combustion gases to provide impingement, convective, and/or conductive cooling to the combustor components. Axial injection of the working fluid across the outside of the combustor components reduces the pressure loss of the working fluid across the combustor, which in turn increases the combustion gas flow and overall efficiency of the gas turbine. However, the structures used to axially inject the working fluid across the outside of the combustor components have increased the complexity, manufacturing costs, and/or maintenance costs associated with the combustor. Therefore, an improved combustor and method for supplying axial flow across the outside of the combustor components would be useful.

BRIEF DESCRIPTION OF THE INVENTION

Aspects and advantages of the invention are set forth below in the following description, or may be obvious from the description, or may be learned through practice of the invention.

One embodiment of the present invention is a device for supplying flow across a combustor. The device includes an axial fluid injector configured to circumferentially surround at least a portion of the combustor. An inner annular passage extends through the axial fluid injector, wherein the inner annular passage provides fluid communication through the axial fluid injector and into a first annular passage that surrounds the combustor. An outer annular passage extends through the axial fluid injector radially outward from the inner annular passage, wherein the outer annular passage provides axial flow into the first annular passage.

Another embodiment of the present invention is a combustor that includes a liner that at least partially defines a combustion chamber and a flow sleeve that circumferentially surrounds the liner to define a first annular passage between the liner and the flow sleeve. An axial fluid injector is adjacent to the flow sleeve and extends circumferentially around the combustor. An inner annular passage extends through the axial fluid injector provides fluid communication through the axial fluid injector and into the first annular passage. An outer annular passage extends through the axial fluid injector radially outward from the inner annular passage provides axial flow into the first annular passage.

The present invention may also include a method for supplying flow to a combustor. The method includes flowing a first portion of a working fluid through a first axial flow path, wherein the first axial flow path is through an inner annular passage in an axial fluid injector that circumferentially surrounds the combustor. The method further includes flowing a second portion of the working fluid through a second axial flow path, wherein the second axial flow path is through an outer annular passage in the axial fluid injector.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
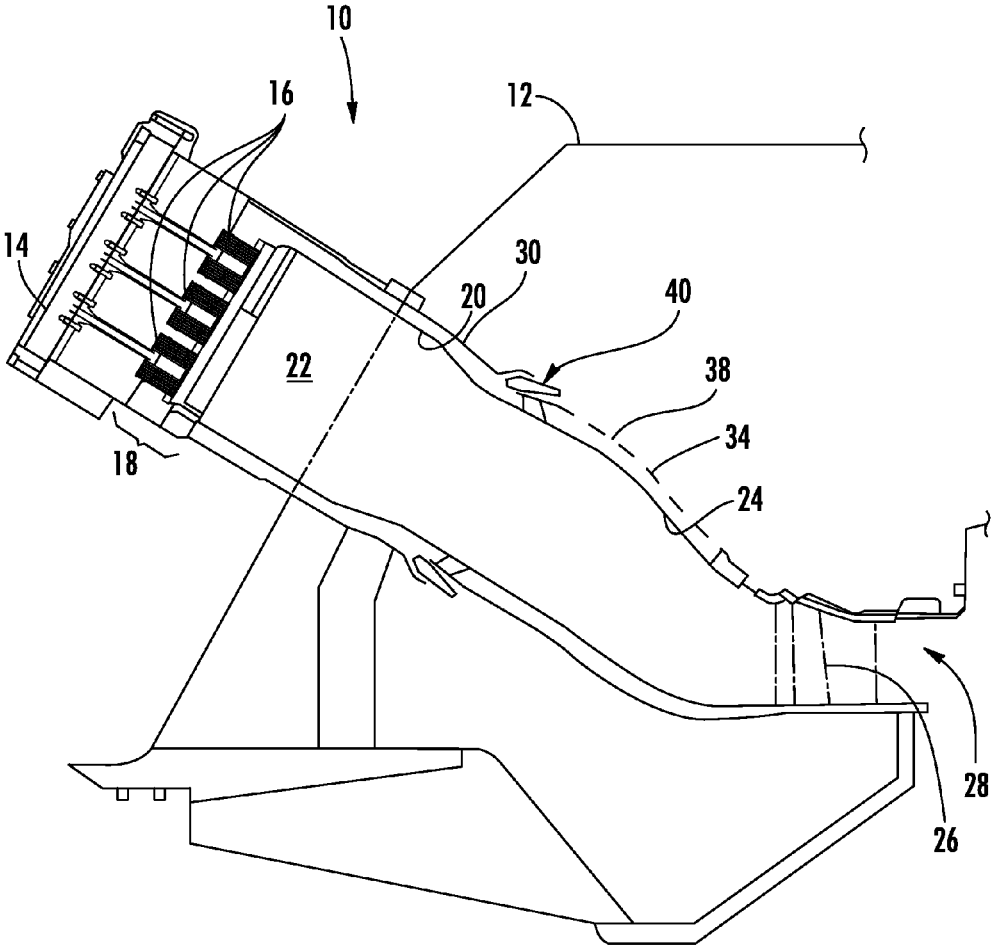
FIG. 1 is a simplified cross-section view of an exemplary combustor within the scope of various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for supplying flow to the combustor. The combustor and method may include a twin axial fluid injector that circumferentially surrounds the combustor to supply multiple axial flows across the combustor. The twin axial fluid injector enhances cooling to the combustor, smoothly merges multiple axial flows across the combustor, and/or reduces pressure and/or flow losses across the combustor. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims. In addition, as used herein, the terms "first", "second", and "third" may be used interchangeably to distinguish one component from another and are not intended to signify particular structure, location, function, or importance of the individual components.

Figure 2:
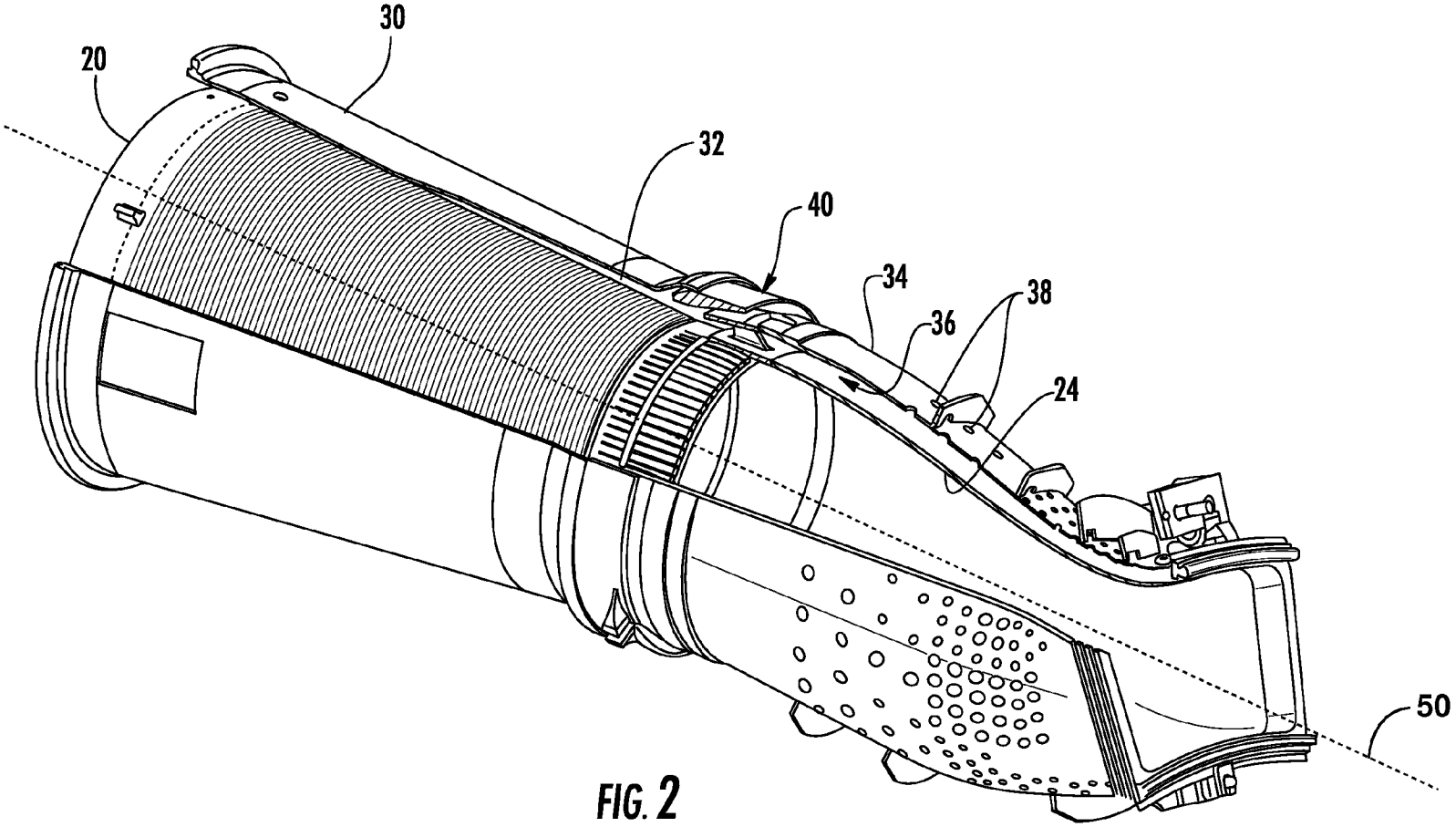
FIG. 2 is a perspective, partial cut-away view of a portion of the combustor shown in FIG. 1 according to one embodiment of the present invention.

FIG. 1 provides a simplified cross-section of an exemplary combustor 10, such as may be included in a gas turbine, and FIG. 2 provides a perspective, partial cut-away view of a portion of the combustor shown in FIG. 1 according to one embodiment of the present invention. As shown in FIG. 1, a casing 12 and an end cover 14 generally enclose the combustor 10, and one or more nozzles 16 may be radially arranged between the end cover 14 and an end cap 18. A generally cylindrical liner 20 is connected to the end cap 18, and the end cap 18 and liner 20 at least partially define a combustion chamber 22 downstream from the end cap 18. The liner 20 connects to a transition piece 24, and the transition piece 24 connects the combustion chamber 22 to a downstream component. For example, as shown in FIG. 1, the transition piece 24 may connect the combustion chamber 22 to a first stage nozzle 26 at the inlet of a turbine 28.

As shown in FIGS. 1 and 2, a flow sleeve 30 may circumferentially surround the liner 20 to define a first annular passage 32 between the liner 20 and the flow sleeve 30. Similarly, an impingement sleeve 34 may circumferentially surround the transition piece 24 to define a second annular passage 36 between the transition piece 24 and the impingement sleeve 34. The impingement sleeve 34 may include a plurality of flow holes 38, and a portion of the working fluid flowing to the combustor 10 may flow through the flow holes 38 and into the second annular passage 36 between the transition piece 24 and the impingement sleeve 34. In this manner, the working fluid may provide impingement, convective, and/or conductive cooling to the outside of the transition piece 24. The working fluid may then flow through an axial fluid injector 40 that circumferentially surrounds the combustor 10 between the liner 20 and the transition piece 24. After flowing through the axial fluid injector 40, the working fluid flows through the first annular passage 32 between the liner 20 and the flow sleeve 30 to similarly provide impingement, convective, and/or conductive cooling to the outside of the liner 20. The working fluid then flows along the outside of the end cap 18 (most clearly shown in FIG. 1) until it reaches the end cover 14, where it reverses direction to flow through the nozzles 16 and into the combustion chamber 22.

Figure 3:
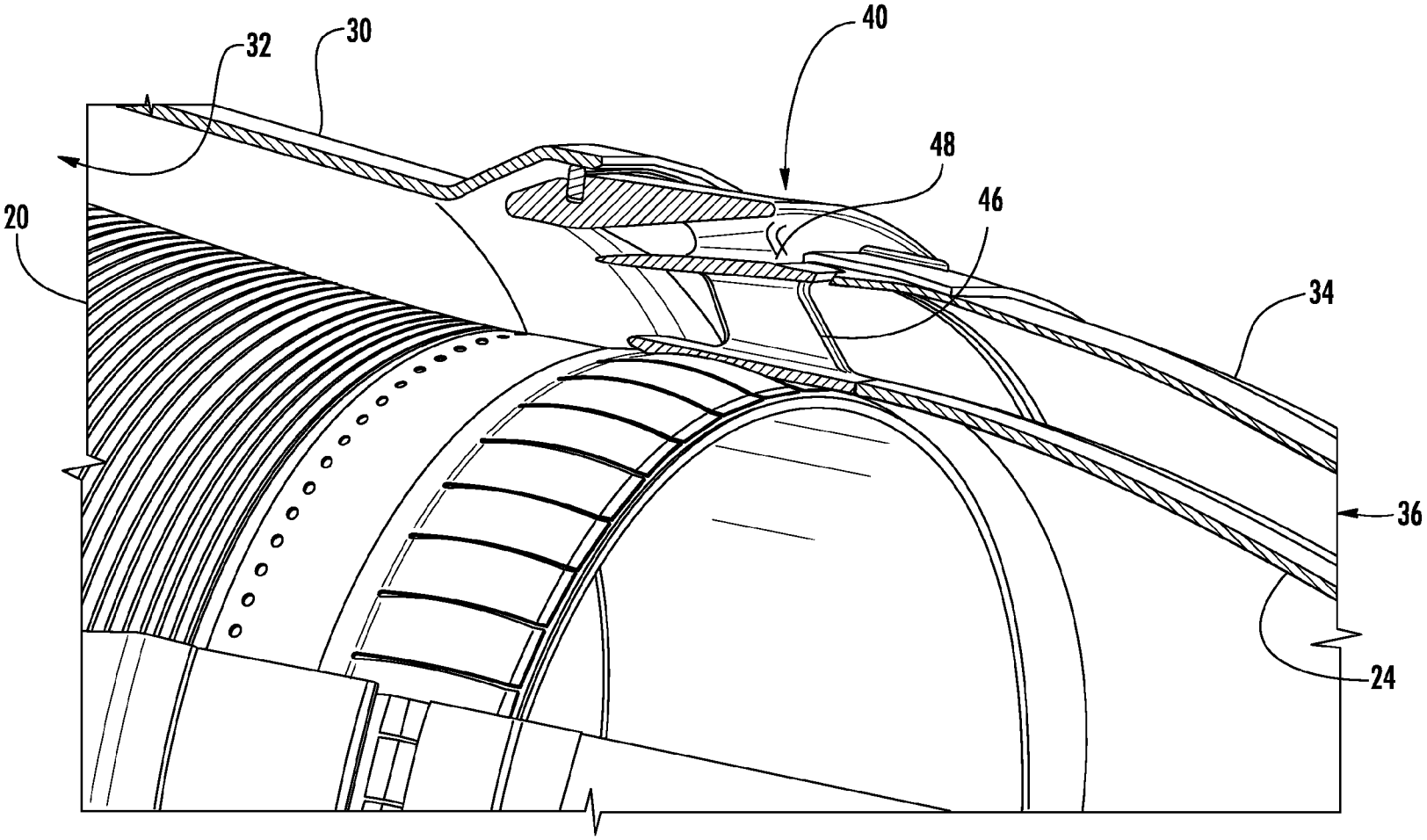
FIG. 3 is an enlarged perspective, partial cut-away view of a portion of the combustor shown in FIG. 2 according to one embodiment of the present invention.
Figure 4:
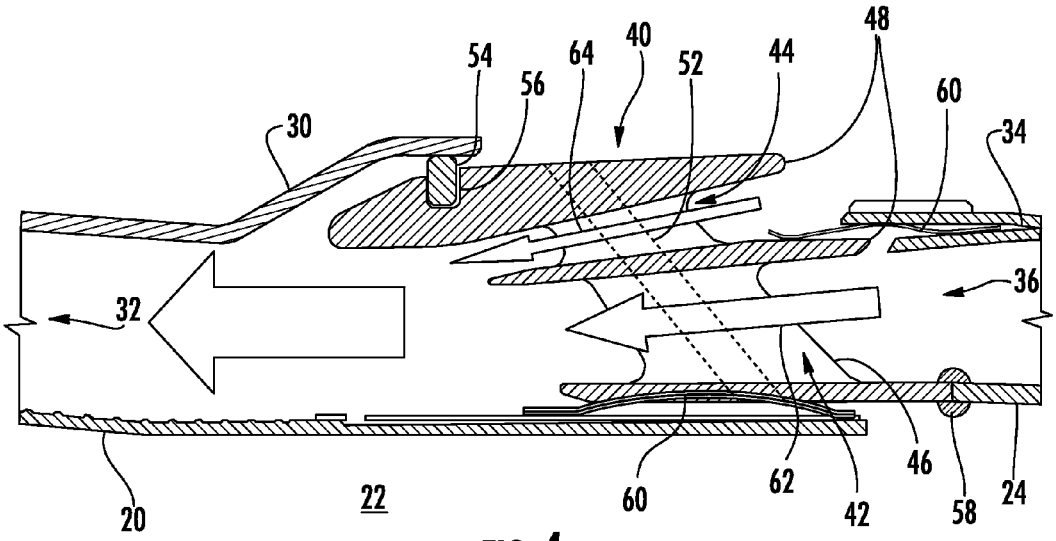
FIG. 4 is a side cross-section view of the axial fluid injector shown in FIG. 3.

FIG. 3 provides an enlarged perspective, partial cut-away view of a portion of the combustor 10 shown in FIG. 2, and FIG. 4 provides a side cross-section view of the axial fluid injector 40 shown in FIG. 3. As shown, the axial fluid injector 40 generally surrounds a portion of the combustor 10 between the first and second annular passages 32, 36 to condition working fluid flow into or through the first and second annular passages 32, 36. The axial fluid injector 40 may include converging and diverging portions that function similar to a nozzle to accelerate and/or inject working fluid flow through the first and second annular passages 32, 36. For example, as shown in FIGS. 3 and 4, an inner annular passage 42 may provide fluid communication between the first and second annular passages 32, 36, and an outer annular passage 44 may provide fluid communication into the first annular passage 32 from outside of the flow sleeve 30 and/or impingement sleeve 34. The inner and outer annular passages 42, 44 may define converging flow paths to increase the velocity of the working fluid flowing through the respective passages 42, 44. After flowing through the respective passages 42, 44, the axial fluid injector 40 may diverge to create a low pressure zone that reduces the velocity and increases the pressure of the working fluid. In addition, the working fluid axially injected through the outer annular passage 44 into the first annular passage 32 creates a low pressure zone that further draws in or accelerates working fluid flowing from the second annular passage 36 through the inner annular passage 42. In this manner, the axial fluid injector 40 accelerates and combines multiple axial flows across the combustor 10.

As further shown in FIGS. 3 and 4, the axial fluid injector 40 may include a plurality of vanes 46 that extend radially across at least one of the inner or outer annular passages 42, 44. In addition to radially separating annular airfoils 48 that partially define or separate the inner and outer annular passages 42, 44, the vanes 46 may be angled or canted with respect to an axial centerline 50 of the combustor 10 to impart a circumferential swirl to the working fluid flowing through the first annular passage 32. Alternately, or in addition, as shown in phantom in FIG. 4, a fluid passage 52 may extend radially inside one or more of the vanes 46 to provide fluid communication through the axial fluid injector 40 to the combustion chamber 22. In this manner, a portion of the working fluid may flow through the fluid passage 52 to provide cooling between the axial fluid injector 40 and the liner 20 before flowing into the combustion chamber 22.

The axial fluid injector 40 may be cast or formed as a single part and subsequently releasably or fixedly connected to one or more adjacent components, thereby simplifying the design, manufacturing costs, and maintenance costs associated with the adjacent components. For example, as shown most clearly in FIG. 4, a split ring 54 may connect the flow sleeve 30 to a groove or slot 56 in the axial fluid injector 40 to provide a releasable connection between the flow sleeve 30 and the axial fluid injector 40. Alternately or in addition, a weld bead 58, braze joint, clamp, or other mechanical device may connect the axial fluid injector 40 to the transition piece 24. In still further embodiments, one or more spring clips 60 may be used to provide a resilient seal between the axial fluid injector 40 and the liner 20, flow sleeve 30, transition piece 24, and/or impingement sleeve 34. One of ordinary skill in the art will readily appreciate that various releasable and/or fixed connections are possible between the axial fluid injector 40 and the adjacent components, and the present invention is not limited to any particular connection unless specifically recited in the claims.

The various embodiments shown and described with respect to FIGS. 1-4 may also provide a method for supplying flow to the combustor 10. The method may include flowing a first portion of the working fluid through a first axial flow path 62 and flowing a second portion of the working fluid through a second axial flow path 64. As shown most clear in FIG. 4, the first axial flow path 62 may be through the inner annular passage 42, and the second axial flow path 64 may be through the outer annular passage 44. In particular embodiments, the method may further include flowing a third portion of the working fluid inside one or more vanes 46 that extend radially across at least one of the inner or outer annular passages 42, 44. Alternately or in addition, the method may include swirling at least one of the first or second portions of the working fluid flowing through the first or second axial flow paths 62, 64.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A device for supplying flow across a combustor, comprising:

a. an axial fluid injector configured to circumferentially surround at least a portion of the combustor, the axial fluid injector comprising a plurality of vanes extending radially with respect to an axial centerline of the combustor, wherein at least one of the vanes includes a fluid passage enclosed within the vane;

b. an inner annular passage extending through the axial fluid injector, wherein the inner annular passage provides fluid communication through the axial fluid injector and into a first annular passage that surrounds the combustor; and c. an outer annular passage extending through the axial fluid injector radially outward from the inner annular passage, wherein the outer annular passage provides axial flow into the first annular passage.

2. The device as in claim 1, wherein the plurality of vanes extend radially with respect to the axial centerline of the combustor across at least one of the inner or outer annular passages.

3. The device as in claim 1, wherein the fluid passage extends radially with respect to the axial centerline of the combustor within the vane.

4. The device as in claim 1, wherein one or more of the vanes are angled with respect to the axial centerline of the combustor.

5. The device as in claim 1, wherein the inner annular passage is larger than the outer annular passage.

6. The device as in claim 1, wherein the inner annular passage provides fluid communication between the first annular passage and a second annular passage that surrounds the combustor.

7. A combustor, comprising:

a. a liner, wherein the liner at least partially defines a combustion chamber;

b. a flow sleeve that circumferentially surrounds the liner to define a first annular passage between the liner and the flow sleeve;

c. an axial fluid injector adjacent to the flow sleeve and extending circumferentially around the combustor, the axial fluid injector comprising a plurality of vanes extending radially with respect to an axial centerline of the combustor, wherein at least one of the vanes includes a fluid passage enclosed within the vane;

d. an inner annular passage extending through the axial fluid injector, wherein the inner annular passage provides fluid communication through the axial fluid injector and into the first annular passage; and e. an outer annular passage extending through the axial fluid injector radially outward from the inner annular passage, wherein the outer annular passage provides axial flow into the first annular passage.

8. The combustor as in claim 7, further comprising a connection between the flow sleeve and the axial fluid injector.

9. The combustor as in claim 7, further comprising a resilient seal between the axial fluid injector and the liner.

10. The combustor as in claim 7, wherein the plurality of vanes extend radially with respect to the axial centerline of the combustor across at least one of the inner or outer annular passages.

11. The combustor as in claim 7, wherein the fluid passage extends radially with respect to the axial centerline of the combustor within the vane.

12. The combustor as in claim 7, wherein one or more of the vanes are angled with respect to the axial centerline of the combustor.

13. The combustor as in claim 7, further comprising a transition piece that connects the combustion chamber to a downstream component.

14. The combustor as in claim 13, wherein the axial fluid injector is connected to the transition piece.

15. The combustor as in claim 13, further comprising an impingement sleeve that circumferentially surrounds the transition piece to define a second annular passage between the transition piece and the impingement sleeve.

16. The combustor as in claim 7, wherein the axial fluid injector is formed as a single part that is releasably connected to the flow sleeve.

17. A method for supplying flow to a combustor, comprising:

a. flowing a first portion of a working fluid through a first axial flow path, wherein the first axial flow path is through an inner annular passage in an axial fluid injector that that circumferentially surrounds the combustor;

b. flowing a second portion of the working fluid through a second axial flow path, wherein the second axial flow path is through an outer annular passage in the axial fluid injector;

c. flowing a third portion of the working fluid through a fluid passage enclosed within a vane that extends radially with respect to an axial centerline of the combustor across at least one of the inner or outer annular passages; and d. combining the flows of the first portion and the second portion of the working fluid at a location downstream of the vane.

18. The method as in claim 17, further comprising swirling at least one of the first or second portions of the working fluid.

19. The method as in claim 17, further comprising merging the first and second portions of the working fluid.

20. The combustor as in claim 16, wherein the axial fluid injector comprises a groove or slot, and wherein a split ring releasably connects the flow sleeve to the groove or slot in the axial fluid injector.

* * * * *